US012729860B2

(12) United States Patent
Santana

(10) Patent No.: US 12,729,860 B2
(45) Date of Patent: Sep. 8, 2026

(54) ADJUSTING A PREHEATING CYCLE ACCORDING TO THERMAL ATTRIBUTES OF COOKWARE ITEMS

(71) Applicant: Haier US Appliance Solutions, Inc., Wilmington, DE (US)

(72) Inventor: Omar Santana, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 744 days.

(21) Appl. No.: 18/310,901

(22) Filed: May 2, 2023

(65) Prior Publication Data

US 2024/0369231 A1 Nov. 7, 2024

(51) Int. Cl.
*F24C 7/08* (2006.01)

(52) U.S. Cl.
CPC ..... *F24C 7/087* (2013.01); *F24C 7/083* (2013.01); *F24C 7/085* (2013.01)

(58) Field of Classification Search
CPC ..... F24C 7/087; F24C 7/083; F24C 7/085
See application file for complete search history.

(56) References Cited

U.S. PATENT DOCUMENTS

| | | | |
|---|---|---|---|
| 8,796,599 | B2 | 8/2014 | Sakakibara et al. |
| 10,641,497 | B2 | 5/2020 | Park et al. |

FOREIGN PATENT DOCUMENTS

| | | | |
|---|---|---|---|
| CN | 110687810 | A | 1/2020 |
| CN | 110701639 | A | 1/2020 |
| JP | 5052632 | B2 | 10/2012 |
| JP | 5286140 | B2 | 9/2013 |
| JP | 6305597 | B2 | 4/2018 |
| WO | WO2018225162 | A1 | 12/2018 |

*Primary Examiner* — Robert G Bachner
(74) *Attorney, Agent, or Firm* — Dority & Manning, P.A.

(57) ABSTRACT

A method of operating a cooking appliance includes receiving a temperature setpoint input for a preheating phase of a cooking operation; retrieving a default power level for at least one heating element in response to receiving the temperature setpoint input; directing the at least one heating element at the default power level over a thermal coupling classification period, the thermal coupling classification period being a portion of the preheating phase; determining a thermal coupling behavior of a cookware item provided on the at least one heating element after an expiration of the thermal coupling classification period; and adjusting one or more parameters of the preheating phase based on the thermal coupling behavior of the cookware item.

20 Claims, 5 Drawing Sheets

ADJUSTING A PREHEATING CYCLE ACCORDING TO THERMAL ATTRIBUTES OF COOKWARE ITEMS

FIELD OF THE INVENTION

The present subject matter relates generally to cooking appliances, and more particularly to methods of improving preheating phases for cooking appliances.

BACKGROUND OF THE INVENTION

Cooking appliances generally have one or more heating elements configured for heating a cookware item. The cookware item, e.g., a pot or a pan, may be positioned on or near the one or more heating elements and food products (including, e.g., food solids, liquid, or water) may be placed inside the cookware item for cooking. Some cooking appliances incorporate a preheating phase to provide heat to the cookware item before performing the cooking operation or cooking phase. A controller may selectively energize the heating element(s) to provide thermal energy to the cookware item during the preheating phase. Alternatively, certain cooking appliances, often referred to as induction cooktops, provide energy in the form of an alternating magnetic field which causes the cookware item to generate heat. In both types of appliances, a controller selectively energizes either the heating element(s) or a magnetic coil to heat the cookware item until it is at or near a temperature setpoint.

Cookware items may exhibit different thermal properties or behaviors. For instance, some cookware items may have slower heat transfer rates, retain heat more easily, or dissipate heat more easily. For cooking appliances that are capable of performing feedback controlled heating operations, one or more algorithms may be used to incorporate certain feedback information (e.g., temperature change, temperature rate of change, etc.) over a predetermined period to intelligently control a power level of the heating element(s). However, when cookware items exhibit different properties, the single feedback control algorithm results in undesirable heating behaviors, such as excessive temperature overshoots, long heat rise times, and the like, leading to unsatisfactory cookware item heat at a conclusion of the preheating phase.

Accordingly, a cooking appliance and method of operating a cooking appliance that obviates one or more of the above-mentioned drawbacks would be desirable. In particular, a cooking appliance capable of adjusting one or more parameters of a heating operation during a preheating phase would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a cooking appliance is provided. The cooking appliance may include at least one heating element to selectively supply heat to a cookware item; a temperature sensor configured to selectively monitor a temperature of the cookware item; and a controller operably connected with the at least one heating element and the temperature sensor, the controller configured to perform a feedback controlled heating operation including a preheating phase. The feedback controlled heating operation may include receiving a temperature setpoint input; retrieving a default power level for the at least one heating element in response to receiving the temperature setpoint input; directing the at least one heating element at the default power level over a thermal coupling classification period, the thermal coupling classification period being a first portion of the preheating phase; determining a thermal coupling behavior of the cookware item after an expiration of the thermal coupling classification period; and adjusting one or more parameters of the feedback controlled heating operation based on the thermal coupling behavior of the cookware item.

In another exemplary aspect of the present disclosure, a method of operating a cooking appliance is provided. The cooking appliance may include at least one heating element and a temperature sensor. The method may include receiving a temperature setpoint input for a feedback controlled heating operation, the feedback controlled heating operation including a preheating phase; retrieving a default power level for the at least one heating element in response to receiving the temperature setpoint input; directing the at least one heating element at the default power level over a thermal coupling classification period, the thermal coupling classification period being a portion of the preheating phase; determining a thermal coupling behavior of a cookware item provided on the at least one heating element after an expiration of the thermal coupling classification period; and adjusting one or more parameters of the feedback controlled heating operation based on the thermal coupling behavior of the cookware item.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
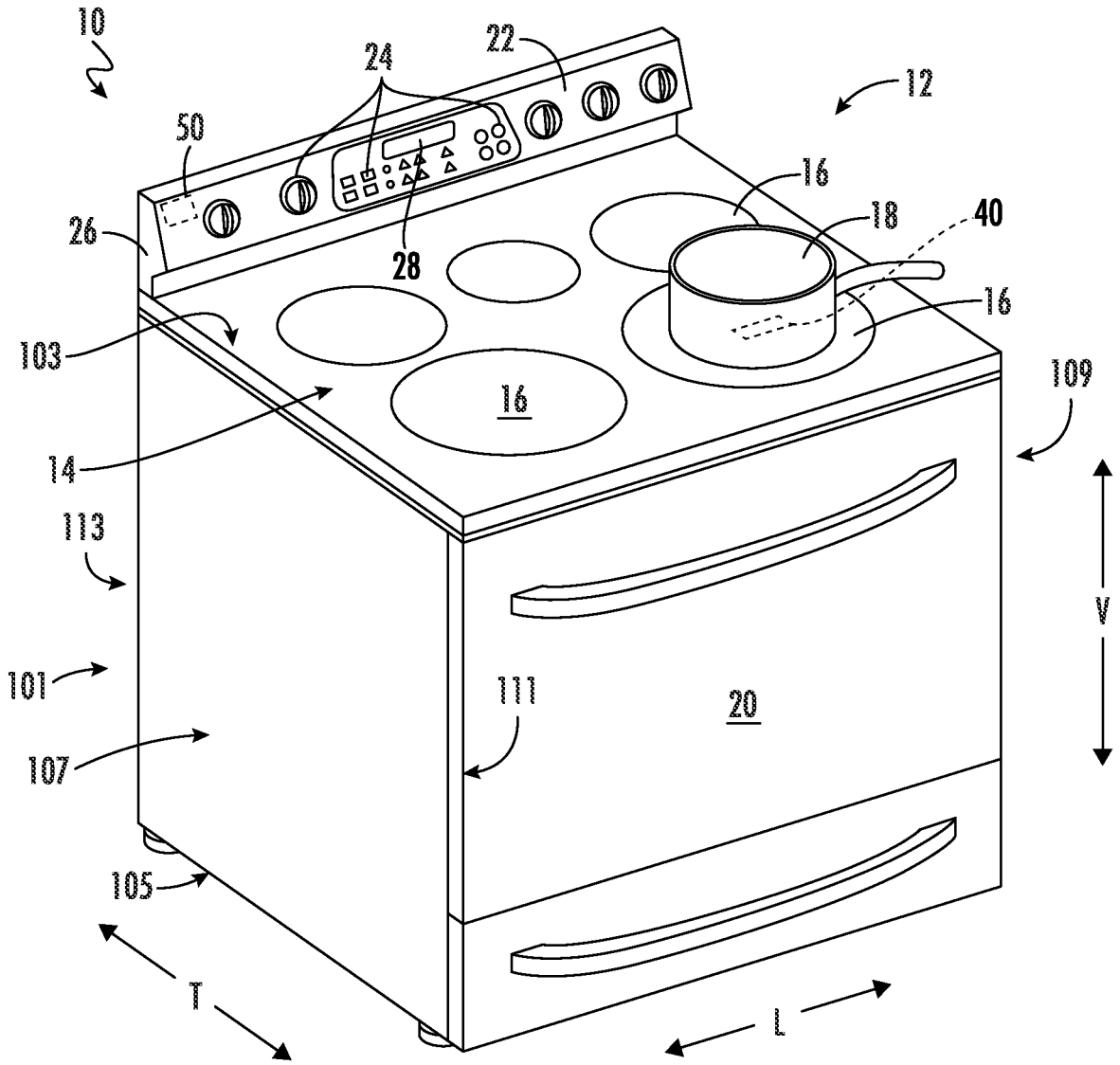
FIG. 1 provides a perspective view of an oven range according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
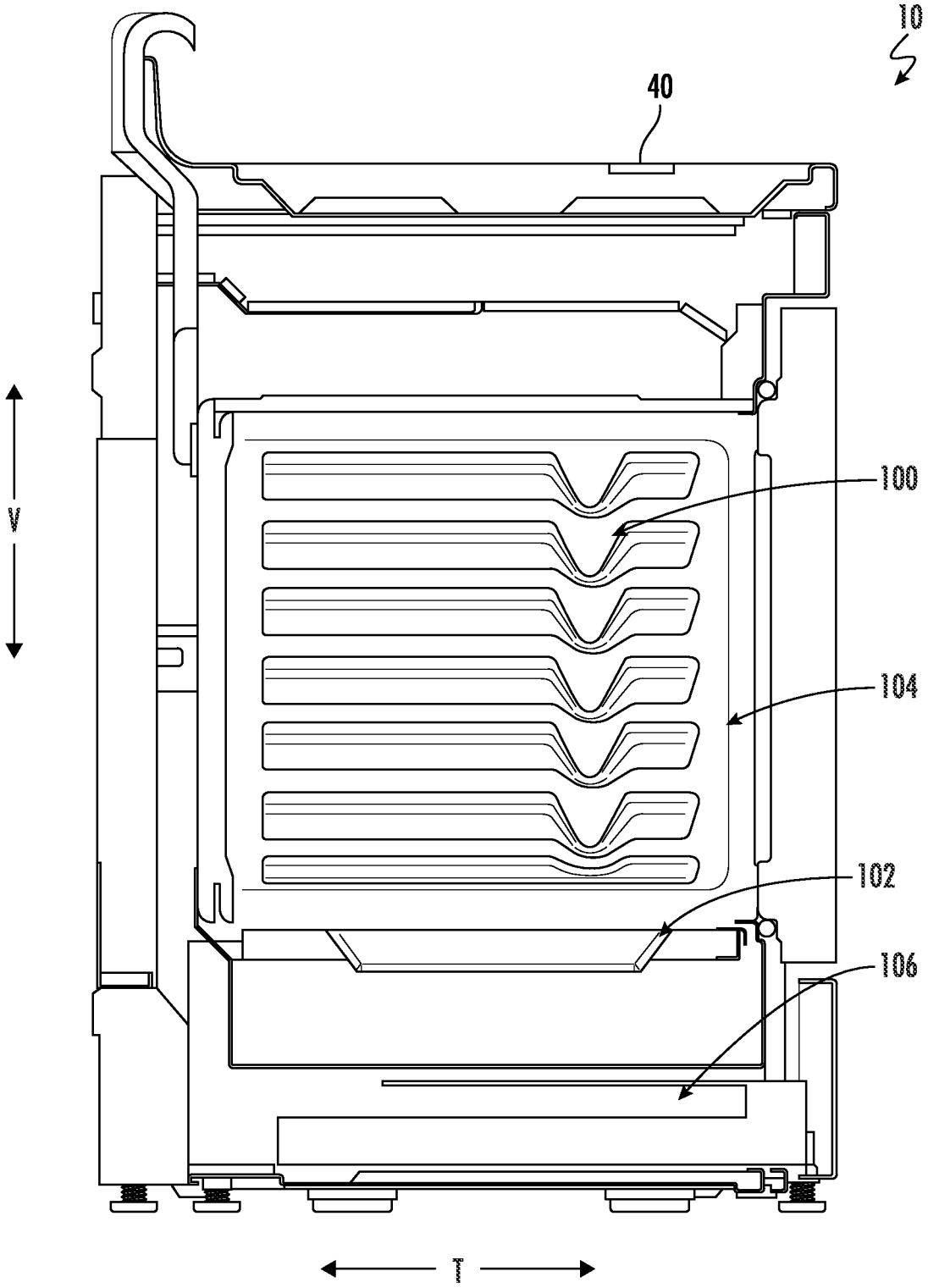
FIG. 2 provides a side cut-away view of the exemplary oven range of FIG. 1.

FIG. 1 provides a perspective view of a cooking appliance, or oven range 10, including a cooktop 12, and FIG. 2 provides a side cut-away view of the cooking appliance 10. Cooking appliance 10 is provided by way of example only and is not intended to limit the present subject matter to the arrangement shown in FIGS. 1 and 2. Thus, the present subject matter may be used with other range 10 and/or cooktop 12 configurations, e.g., double oven range appliances. As illustrated, cooking appliance 10 generally defines a vertical direction V, a lateral direction L, and a transverse direction T, each of which is mutually perpendicular, such that an orthogonal coordinate system is generally defined. Cooking appliance 10 may include a cabinet 101 that extends between a top 103 and a bottom 105 along the vertical direction V, between a left side 107 and a right side 109 along the lateral direction, and between a front 111 and a rear 113 along the transverse direction T.

A cooking surface 14 of cooktop 12 may include a plurality of heating elements 16. For the embodiment depicted, cooktop 12 includes five heating elements 16 spaced along cooking surface 14. Heating elements 16 may be electric heating elements and are positioned at, e.g., on or proximate to, the cooking surface 14. In certain exemplary embodiments, cooktop 12 is a radiant cooktop with resistive heating elements or coils mounted below cooking surface 14. However, in other embodiments, the cooktop appliance 12 includes other suitable shape, configuration, and/or number of heating elements 16, for example, cooktop 12 may be an open coil cooktop with heating elements 16 positioned on or above surface 14. Additionally or alternatively, in other embodiments, cooktop 12 may include any other suitable type of heating element 16, such as an induction heating element. Each of the heating elements 16 may be the same type of heating element 16, or cooktop 12 may include a combination of different types of heating elements 16.

As shown in FIG. 1, a cooking utensil (or cookware item) 18, such as a pot, pan, or the like, may be placed on a heating element 16 to heat the cookware item 18 and cook or heat food items placed within cookware item 18. Cooking appliance 10 may also include a door 20 that permits access to a cooking chamber 104 of oven range 10, e.g., for cooking or baking of food items therein. A control panel 22 having controls 24 may permit a user to make selections for cooking of food items. Although shown on a backsplash or back panel 26 of oven range 10, control panel 22 may be positioned in any suitable location.

Controls 24 may include buttons, knobs, and the like, as well as combinations thereof, and/or controls 24 may be implemented on a remote user interface device such as a smartphone. As an example, a user may manipulate one or more controls 24 to select a temperature and/or a heat or power output for each heating element 16 and the cooking chamber 104. The selected temperature or heat output of heating element 16 affects the heat transferred to cookware item 18 placed on heating element 16. A display 28 may be provided (e.g., on or in control panel 22). Display 28 may display information regarding cooking operations or inputs from a user regarding the cooking operation. Display 28 may be any suitable display capable of providing visual feedback, such as a liquid crystal display (LCD), a light emitting diode (LED) display, a segmented display, or the like. Additionally or alternatively, display 28 may be a touch display capable of receiving touch inputs from a user.

Cooktop appliance 12 may further include or be in operative communication with a processing device or a controller 50 that may be generally configured to facilitate appliance operation. In this regard, control panel 22, controls 24, and display 28 may be in communication with controller 50 such that controller 50 may receive control inputs from controls 24, may display information using display 28, and may otherwise regulate operation of cooking appliance 10. For example, signals generated by controller 50 may operate cooking appliance 10, including any or all system components, subsystems, or interconnected devices, in response to the position of controls 24 and other control commands. Control panel 22 and other components of appliance 10 may be in communication with controller 50 via, for example, one or more signal lines or shared communication busses. In this manner, Input/Output ("I/O") signals may be routed between controller 50 and various operational components of appliance 10.

As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Alternatively, controller 50 may be constructed without using a microprocessor, e.g., using a combination of discrete analog and/or digital logic circuitry (such as switches, amplifiers, integrators, comparators, flip-flops, AND/OR gates, and the like) to perform control functionality instead of relying upon software.

Controller 50 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor or may be included onboard within the processor. In addition, these memory devices can store information and/or data accessible by the one or more processors, including instructions that can be executed by the one or more processors. It should be appreciated that the instructions can be software written in any suitable programming language or can be implemented in hardware. Additionally, or alternatively, the instructions can be executed logically and/or virtually using separate threads on one or more processors.

For example, controller 50 may be operable to execute programming instructions or micro-control code associated with an operating cycle of cooking appliance 10. In this regard, the instructions may be software or any set of instructions that when executed by the processing device, cause the processing device to perform operations, such as running one or more software applications, displaying a user interface, receiving user input, processing user input, etc. Moreover, it should be noted that controller 50 as disclosed herein is capable of and may be operable to perform any methods, method steps, or portions of methods as disclosed herein. For example, in some embodiments, methods disclosed herein may be embodied in programming instructions stored in the memory and executed by controller 50.

The memory devices may also store data that can be retrieved, manipulated, created, or stored by the one or more processors or portions of controller 50. The data can include, for instance, data to facilitate performance of methods described herein. The data can be stored locally (e.g., on controller 50) in one or more databases and/or may be split up so that the data is stored in multiple locations. In addition, or alternatively, the one or more database(s) can be connected to controller 50 through any suitable network(s), such as through a high bandwidth local area network (LAN) or wide area network (WAN). In this regard, for example, controller 50 may further include a communication module or interface that may be used to communicate with one or more other component(s) of appliance 10, controller 50, an external appliance controller, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

Cooking appliance 10 may include a temperature sensor 40. Temperature sensor 40 may be configured to selectively sense a temperature of a cookware item (e.g., cookware item 18) as it is heated. For instance, temperature sensor 40 may be integrally formed with cooking appliance 10 (e.g., within cooktop 12, within cooking chamber 104, etc.). In some embodiments, temperature sensor 40 is operably connected to cooking appliance 10 (e.g., via a port or socket, via a remote connection, etc.). For one example, temperature sensor 40 is provided within cookware item 18 and operably connected to controller 50 during a cooking operation. Temperature sensor 40 may monitor a temperature of cookware item 18 or a food item provided within cookware item 18. Accordingly, temperature sensor 40 may deliver signals (e.g., voltage signals) representing the temperature of cookware item 18 to controller 50. The signals may be sent according to a predetermined frequency (e.g., at predetermined time intervals). Thus, controller 50 may analyze a temperature or temperature change of cookware item 18.

As used herein, "temperature sensor" or the equivalent is intended to refer to any suitable type of temperature measuring system or device positioned at any suitable location for measuring the desired temperature. Thus, for example, temperature sensor 40 may be any suitable type of temperature sensor, such as a thermistor, a thermocouple, a resistance temperature detector, a semiconductor-based integrated circuit temperature sensor, etc. In addition, temperature sensor 40 may be positioned at any suitable location and may output a signal, such as a voltage, to a controller that is proportional to or indicative of the temperature being measured. Although exemplary positioning of temperature sensors is described herein, it should be appreciated that appliance 10 may include any other suitable number, type, and position of temperature or other sensors according to alternative embodiments.

Figure 3:
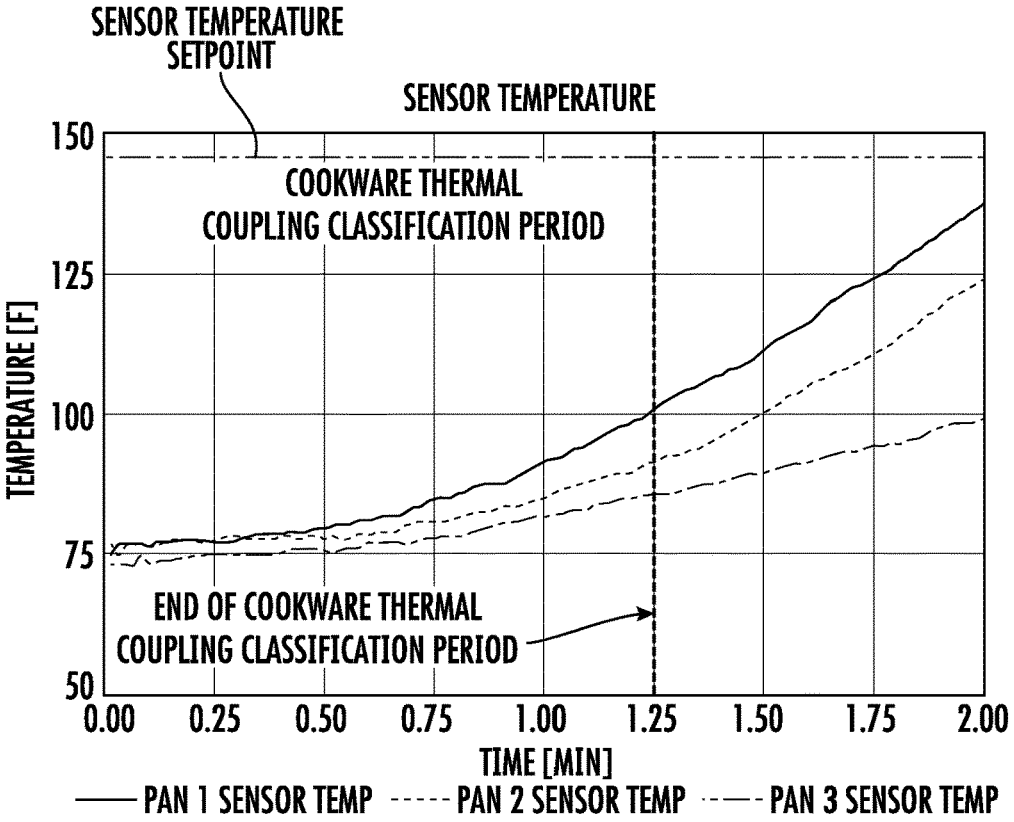
FIG. 3 provides a graph illustrating a temperature change at a temperature sensor of various cookware items over a length of time.

Referring now to FIG. 3, a graph illustrating temperature changes at a temperature sensor of different types of cookware over a predetermined period of time is shown. For instance, temperature sensor 40 may monitor the temperature of cookware item 18 over the course of a preheating phase of the cooking operation. The preheating phase may include a cookware thermal coupling classification period (CTCCP). During the CTCCP, a thermal behavior of cookware item 18 may be determined (e.g., within controller 50). The CTCCP may be predetermined within appliance 10 (e.g., during programming or manufacturing) according to empirical testing. For instance, the CTCCP may be defined between an initiation of the preheating phase to between about 1 minute and about 3 minutes (e.g., around 1.25 minutes). During the CTCCP, temperature sensor 40 may continually send temperature signals to controller 50. In additional or alternative embodiments, the temperature signals are sent to controller periodically (e.g., every 5 seconds, every 10 seconds, etc.).

The cooking operation (e.g., the preheating phase) may be a feedback controlled heating operation. In detail, the preheating phase may intelligently adjust one or more parameters according to feedback with respect to cookware item 18, a food being cooked, cooking appliance 100, or the like (e.g., at a second portion of the preheating phase, described below). Temperature sensor 40 may continually send temperature signals to controller 50 which may then determine, for instance, an error value associated with the feedback controlled preheating phase. The error value may be a difference between a temperature setpoint and an actual observed temperature (e.g., via temperature sensor 40). The error value may be accumulated over the CTCCP to determine an adjustment to be made to a control variable for the second portion of the preheating phase. For instance, the control variable may be a power level of heating element 16.

According to at least some embodiments, the accumulated error term is calculated or presented as an accumulated area (e.g., between a temperature setpoint for the temperature sensor and an observed or measured temperature at the temperature sensor). For instance, the algorithm may be represented as:

$$\text{Area} = \text{Area}_{prev} + K * e * T_s$$

where K is an area adjustment factor, e is an error term or value (e.g., the difference between the setpoint and the temperature at the measurement), $T_s$ is the sampling period, and $\text{Area}_{prev}$ is the area accumulated up until the previous sampling time. As can be seen, a total area for the first portion (e.g., the CTCCP) of the preheating phase may be calculated by amassing each calculated error.

According to some embodiments, the Area term is accumulated over the course of the CTCCP (e.g., as a function of the error term e). In detail, because each iteration of the Area term incorporates the previous accumulated Area term (e.g., $\text{Area}_{prev}$), a total Area term over the predetermined length of time is calculated. Each Area term (e.g., instantaneous or current Area term) is added to the previous accumulated Area term, generating a complete area term for the predetermined length of time.

According to some applications, the Area term is determined as an area between the temperature setpoint and the actual measured temperature (e.g., over the CTCCP). As mentioned above, a temperature measurement (e.g., of the cookware item) may be taken at distinct sampling points (e.g., as determined by $T_s$). For each measurement, an approximate area between the previous sampling time and the current sampling time, and between the temperature setpoint and the actual observed temperature is determined.

Accordingly, an accumulated Area term over the CTCCP may vary between different cookware items. For instance, varying properties of each individual cookware item may alter the thermal behavior of the cookware item, such as heating rate, heat retention, heat distribution, or the like. Referring to FIG. 3, temperature changes of different types of cookware items over a length of time at a temperature sensor are provided, in addition to the sensor temperature setpoint and an exemplary end of the CTCCP. As can be seen in FIG. 3, the longer the sensor temperature takes to reach the sensor temperature setpoint, the greater the accumulated Area term. For instance, as the error between the observed actual temperature and the temperature setpoint remains large, the Area term will aggregate larger over the CTCCP. Advantageously, cooking appliance 10 may utilize information calculated within the controller to adjust parameters of a preheating phase of a cooking operation (e.g., the second portion of the preheating phase), eliminating the need for excessive combined algorithms to optimize preheating times and power levels.

Figure 4:
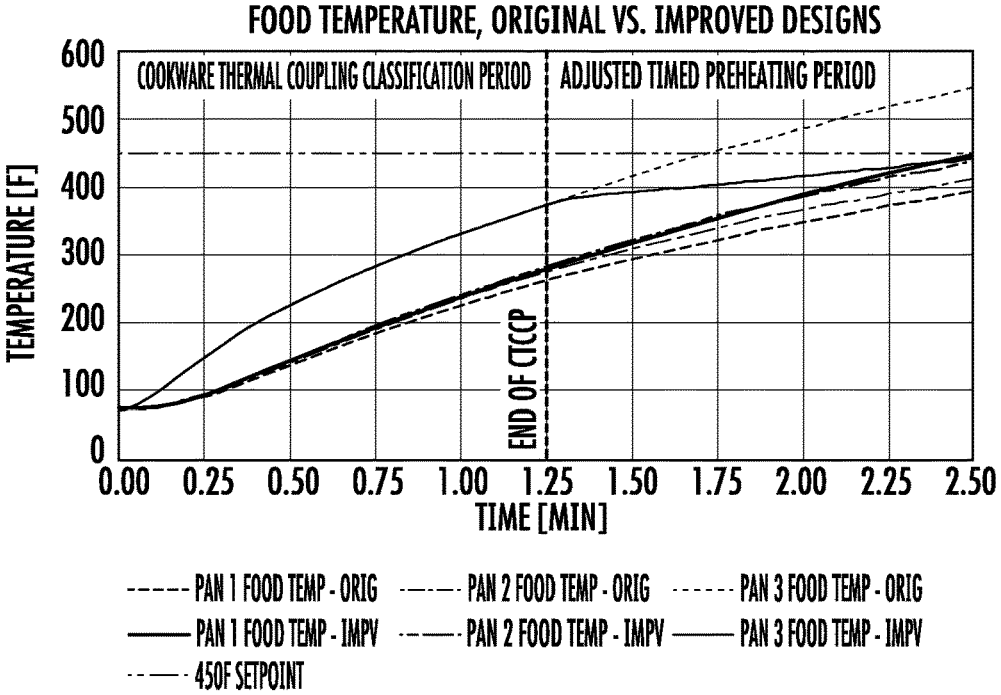
FIG. 4 provides a graph illustrating temperature changes of various cookware items during each of a cookware thermal coupling classification period and an adjusted timed preheating period according to an exemplary embodiment of the present disclosure.
Figure 5:
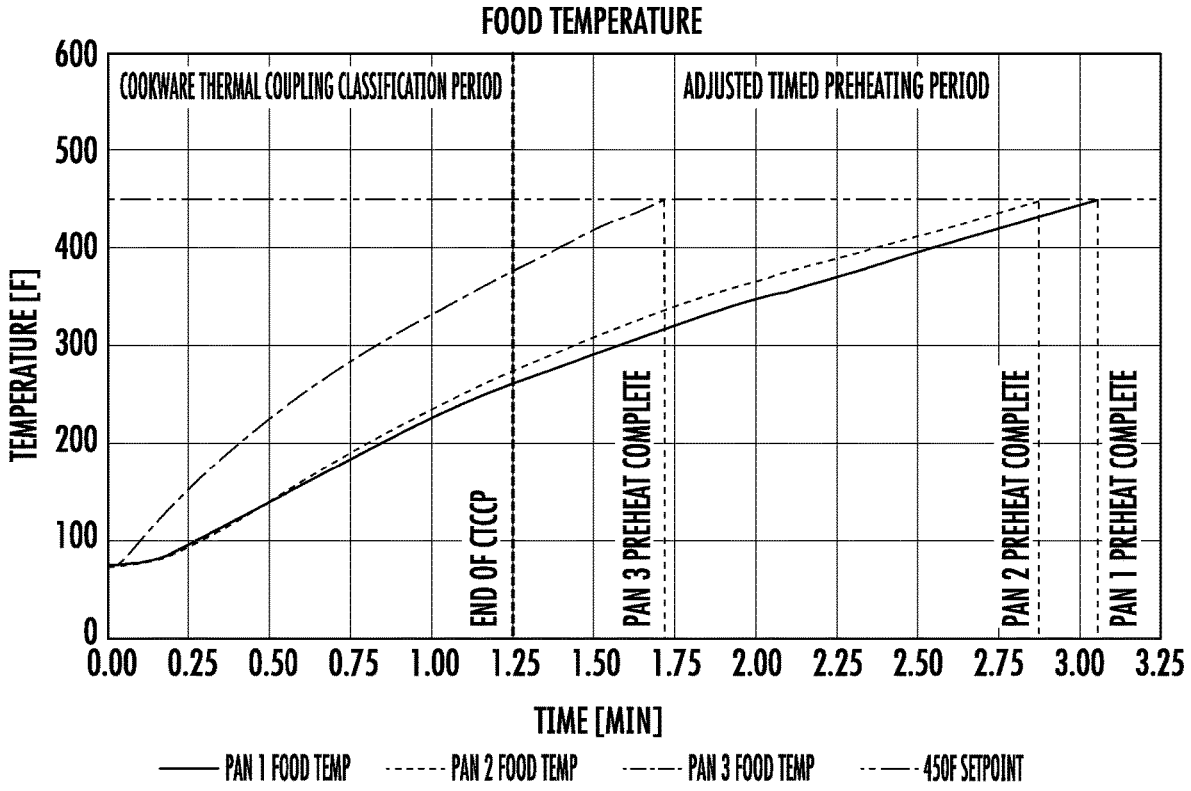
FIG. 5 provides a graph illustrating adjusted preheating phase completion times according to exemplary embodiments of the present disclosure.

FIG. 5 provides an additional or alternative embodiment (e.g., method) of adjusting a preheating phase according to information gleaned from the CTCCP. For instance, as will be described further below, according to FIG. 4, a power level during the preheating phase is adjusted upon determining one or more thermal coupling behaviors (e.g., thermal coupling factors) determined according to the CTCCP. FIG. 5, meanwhile, illustrates adjusting a length of time of an adjusted timed preheating period. For instance, the preheating phase may be divided into a first portion and a second portion. The first portion may be the CTCCP, during which the thermal coupling factor or factors are determined. The second portion may be the adjusted timed preheating period, during which the thermal coupling factor or factors are applied (e.g., to the heating element) to perform the remainder of the preheating phase. Thus, the second portion (adjusted timed preheating period) may incorporate an adjusted power level of the heating element, an adjusted remaining time of the preheating phase, or the like. Additionally or alternatively, the second portion may incorporate two or more of the above-mentioned adjustments.

Figure 6:
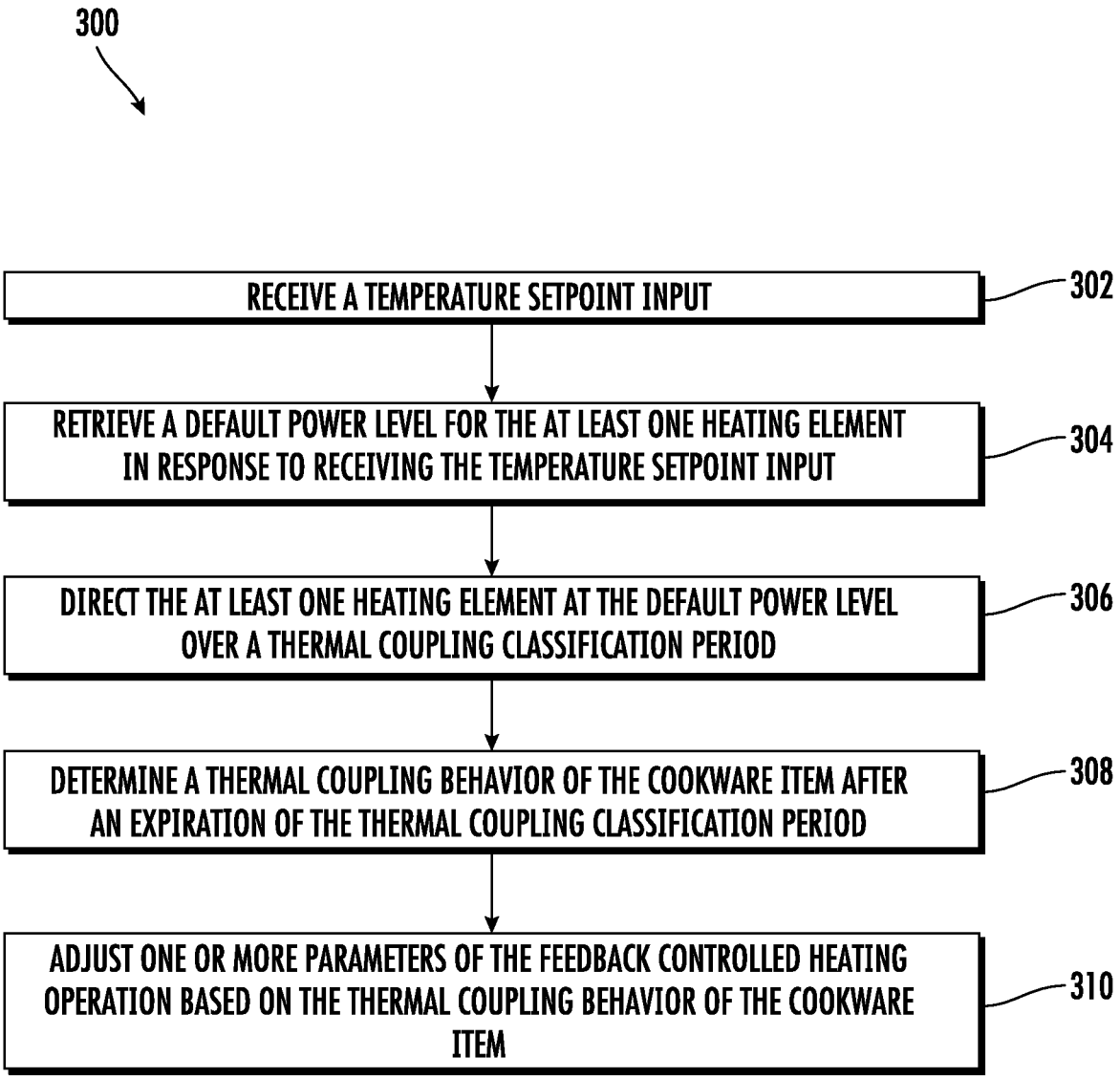
FIG. 6 provides a flow chart illustrating a method of operating a cooking appliance according to an exemplary embodiment.

Now that the construction of cooking appliance 10 and a configuration of controller 50 according to exemplary embodiments have been presented, exemplary method 300 of operating a cooking appliance will be described with reference to FIG. 6. Although the discussion below refers to the exemplary method 300 of operating cooking appliance 10, one skilled in the art will appreciate that the exemplary method 300 is applicable to the operation of a variety of other cooking appliances. In exemplary embodiments, the various method steps as disclosed herein may be performed by controller 50 or a separate, dedicated controller. Additionally or alternatively, the various method steps may be performed in a different order, including additional steps or omitting certain steps according to specific embodiments.

At step 302, method 300 may include receiving a temperature setpoint input. In detail, a user may communicate with the cooking appliance (e.g., cooking appliance 10) a desire to initiate a cooking operation, a heating operation, or the like. For example, the cooking operation is a feedback controlled heating operation including a preheating phase to continually monitor the preheating phase and perform adjustments as needed. The user may manually enter a temperature setpoint (e.g., a temperature at which the user desires to have the item cooked). Thus, using a user interface (e.g., control panel 22), the user may enter a specific cooking temperature as the temperature setpoint (e.g., 250° F., 300° F., 350° F., etc.). In additional or alternative embodiments, the user may provide information regarding a specific food item to be cooked (e.g., eggs, meat, vegetables, etc.). For instance, the cooking appliance may include features for selecting predetermined food items from the user interface or the cooking appliance may include a remote connectivity (e.g., wireless fidelity [WiFi], Bluetooth®, etc.), through which the user may select a food item (e.g., via a remote device). Thus, in some instances, the temperature setpoint may be determined or inferred through an input such as a food item. Further still, the user may input a particular recipe to be cooked on or in the cooking appliance. The temperature setpoint may be stored within the cooking appliance (e.g., within a controller or a memory therein).

At step 304, method 300 may include retrieving a default power level for the at least one heating element. In detail, in response to receiving (or determining) the temperature setpoint input, the cooking appliance may initiate the preheating phase by activating the heating element at a default (or first) power level. Thus, the default power level may be a general power level associated with the temperature setpoint (e.g., proportionally related thereto).

At step 306, method 300 may include directing the at least one heating element at the default power level over the thermal coupling classification period (e.g., the CTCCP). The heating element may thus be operated at the default power level for the first portion of the preheating phase (e.g., throughout the CTCCP). As mentioned above, the CTCCP may be set at a default length of time (e.g., around 1.25 minutes). As mentioned above, the heating element performing the feedback controlled heating operation may be activated to supply heat to the cookware item. For instance, the heating element may be driven at a certain power percentage (e.g., 60%, 70%, 80%, etc.) over the CTCCP. Additionally or alternatively, the heating element may be driven at a variable power rate over the CTCCP. For instance, the feedback controlled heating operation (e.g., at the preheating phase) may begin adjusting the power output of the heating element according, in part, to the current and accumulated error value (e.g., the difference between the sensor temperature setpoint and the actual observed temperature at the temperature sensor). For instance, the sensor temperature setpoint may be equal to or determined from the temperature setpoint received at step 302.

At step 308, method 300 may include determining a thermal coupling behavior of the cookware item after an expiration of the thermal coupling classification period (e.g., CTCCP). According to at least one example, after the CTCCP has ended (e.g., after the first portion of the preheating phase), the cooking appliance analyzes the accumulated area (Area) term over the course of the CTCCP. In analyzing the accumulated Area term, a general thermal behavior of the cookware item may be determined. As mentioned above, the thermal behavior may include such characteristics as heat transfer rate, heat retention, heat distribution (e.g., over an entirety of the cookware item or to a food item or other item provided in or on the cookware item), temperature rate of change, or the like. Accordingly, by analyzing the accumulated Area term, the cooking appliance may determine a proper or specific set of parameters to be set for the second portion of the preheating phase (e.g., the adjusted timed preheating period) to most effectively reach the temperature setpoint input by an end of the preheating phase.

As described above, the accumulated Area term may be determined by or according to a difference between the sensor temperature setpoint and the actual observed temperature at the temperature sensor over the CTCCP. Accordingly, this may be defined as an area (e.g., within the CTCCP) between the sensor temperature setpoint and the actual observed temperature at the temperature sensor. For instance, when the Area term is greater (e.g., relatively greater as compared against multiple accumulated Area terms associated with different cookware items), the thermal behavior of the present cookware item may be deemed to have a low heat transfer rate (e.g., temperature rate of change), for example. Additional or alternative thermal attributes of the cookware item may be gleaned, determined, calculated, or otherwise determined, and the disclosure is not limited to the examples given herein.

Step 308 may include classifying, identifying, or otherwise storing the cookware item according to the determined thermal behavior. For instance, the cooking appliance (e.g., within the controller or a memory) may assign a unique identification to the cookware item and store the identification within the memory. Cooking appliance may include one or more tables (e.g., lookup tables) including cookware identifiers and associated thermal behavior attributes. Accordingly, previously used cookware items may be easily retrieved for future use. Additionally or alternatively, some cookware items may exhibit similar thermal behaviors as other different cookware items (e.g., a small cast iron pan and a large aluminum pot). Accordingly, in some instances, multiple cookware items may be stored under the same or similar identifiers.

According to another embodiment, the thermal coupling behavior of the cookware item may be determined according to a thermal coupling factor. The thermal coupling factor may be a degree of thermal coupling between the cookware item and the temperature sensor. For instance, the thermal coupling factor may be determined as a result of one or more equations. For one equation, a change in temperature over the CTCCP may be calculated (e.g., as a slope, such as $\Delta T/\Delta t$). According to still another embodiment, a temperature threshold may be associated with a particular cookware item (e.g., based on the temperature setpoint input). Thus, the thermal coupling factor may be determined as an amount of time taken to reach the temperature threshold. It should be noted that additional or alternative equations or operations may be instituted to determine the thermal coupling behavior, and the disclosure is not limited to the examples given herein.

At step 310, method 300 may include adjusting one or more parameters of the feedback controlled heating operation based on the thermal coupling behavior of the cookware item. For instance, the resulting thermal coupling factor may be associated with an adjusted parameter for the feedback controlled heating operation (e.g., the preheating phase or the second portion of the preheating phase). For instance, the method 300 may retrieve an adjusted power level as the parameter, from a lookup table, such as:

| Cookware Identification | Thermal Coupling Factor | Default Power Level [%] | Adjusted Power Level [%] |
|---|---|---|---|
| 1 | 4887 | 39 | 43 |
| 2 | 5231 | 39 | 42 |
| 3 | 5456 | 39 | 27 |

The cookware identification may be a placeholder for one or more identified cookware items (e.g., as prestored or as determined through previous coupling). The thermal coupling factor may be the determined thermal coupling behavior. The default power level may be the power level at which the preheating phase is initiated (e.g., as associated with the temperature setpoint input). The adjusted power level is the resulting power level after incorporating the thermal coupling factor. It should be noted that the table above is provided merely as an example, and the parameters to be adjusted may include additional or alternative features from the power level, such as a total preheat time or the like. Additionally or alternatively, a unique lookup table may be provided for each individual heating element of the cooking appliance.

As can be seen, the adjusted parameter (e.g., adjusted power level) may be adjusted to be higher or lower than the default power level. Referring briefly to FIG. 4, when the adjusted power level is lowered (e.g., for cookware 3), a rate of temperature increase is reduced for the second portion of the preheating phase (e.g., the adjusted timed preheating period). When the adjusted power level is raised (e.g., for cookware 1 or cookware 2), a rate of temperature increase is raised for the second portion of the preheating phase. Advantageously, each respective cookware item exhibiting different thermal characteristics may achieve a similar temperature at the end of the preheating phase.

Moreover, as mentioned above, the thermal coupling behavior may be utilized to alter a remaining duration of the preheating phase (e.g., for the second portion or adjusted timed preheating portion). The adjusted duration may be determined similarly to the adjusted power level as described above (e.g., via one or more equations, via a lookup table, etc.). For one example, a lookup table associating the determined thermal coupling factor with an adjusted preheating phase duration may be provided as such:

| Cookware Identification | Thermal Coupling Factor | Default Duration [sec] | Adjusted Duration [sec] |
|---|---|---|---|
| 1 | 4887 | 75 | 110 |
| 2 | 5231 | 75 | 101 |
| 3 | 5456 | 75 | 30 |

As can be seen, the adjusted duration for the preheating phase (e.g., the second portion of the preheating phase) may be greater than or less than the original duration of the preheating phase. As seen in FIG. 5, according to the adjusted durations for each of the cookware items, the temperature setpoint input may be accurately reached according to the adjusted duration.

Additionally or alternatively, the determined thermal behavior or attributes of the cookware item may be used to adjust menu options for heating operations (e.g., preheating operations), user interface displays or potential selections, appropriate burner selections or heating profiles, or the like. The adjusted parameters may thus be implemented into the second portion of the preheating phase.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooking appliance comprising:

at least one heating element to selectively supply heat to a cookware item;

a temperature sensor configured to selectively monitor a temperature of the cookware item; and a controller operably connected with the at least one heating element and the temperature sensor, the controller configured to perform a feedback controlled heating operation comprising a preheating phase, the feedback controlled heating operation comprising:

receiving a temperature setpoint input;

retrieving a default power level for the at least one heating element in response to receiving the temperature setpoint input;

directing the at least one heating element at the default power level over a thermal coupling classification period, the thermal coupling classification period being a first portion of the preheating phase;

determining a thermal coupling behavior of the cookware item after an expiration of the thermal coupling classification period; and adjusting one or more parameters of the feedback controlled heating operation based on the thermal coupling behavior of the cookware item.

2. The cooking appliance of claim 1, wherein the thermal coupling behavior of the cookware item comprises a degree of thermal coupling between the cookware item and the temperature sensor defined as a thermal coupling factor.

3. The cooking appliance of claim 2, wherein the thermal coupling factor is determined according to a temperature change at the temperature sensor over the thermal coupling classification period.

4. The cooking appliance of claim 1, wherein determining the thermal coupling behavior of the cookware item comprises:

determining an accumulated term based on a difference between a sensed temperature at the temperature sensor and the temperature setpoint over the thermal coupling classification period.

5. The cooking appliance of claim 4, wherein the accumulated term is an area between the temperature setpoint and the sensed temperature over the thermal coupling classification period.

6. The cooking appliance of claim 1, wherein adjusting the one or more parameters of the feedback controlled heating operation comprises:

adjusting a power level of the at least one heating element according to the determined thermal coupling behavior, the power level of the at least one heating element being adjusted from the default power level to an adjusted power level.

7. The cooking appliance of claim 6, wherein the adjusted power level is one of a plurality of adjusted power levels, the plurality of adjusted power levels being stored within a lookup table.

8. The cooking appliance of claim 6, wherein the adjusted power level is determined according to one or more equations based on the determined thermal coupling behavior and the temperature setpoint input.

9. The cooking appliance of claim 6, wherein the feedback controlled heating operation further comprises:

directing the at least one heating element according to the adjusted power level for a remainder of the preheating phase.

10. The cooking appliance of claim 1, wherein the thermal coupling classification period is defined between an initiation of the at least one heating element and 75 seconds.

11. The cooking appliance of claim 1, wherein the preheating phase comprises the first portion and a second portion following the first portion.

12. The cooking appliance of claim 11, wherein adjusting one or more parameters of the feedback controlled heating operation based on the thermal coupling behavior of the cookware item comprises:

adjusting the second portion of the preheating phase based on the determined thermal coupling behavior, the second portion of the preheating phase following the thermal coupling classification period.

13. A method of operating a cooking appliance, the cooking appliance comprising at least one heating element and a temperature sensor, the method comprising:

receiving a temperature setpoint input for a feedback controlled heating operation, the feedback controlled heating operation comprising a preheating phase;

retrieving a default power level for the at least one heating element in response to receiving the temperature setpoint input;

directing the at least one heating element at the default power level over a thermal coupling classification period, the thermal coupling classification period being a portion of the preheating phase;

determining a thermal coupling behavior of a cookware item provided on the at least one heating element after an expiration of the thermal coupling classification period; and adjusting one or more parameters of the feedback controlled heating operation based on the thermal coupling behavior of the cookware item.

14. The method of claim 13, wherein the thermal coupling behavior of the cookware item comprises a degree of thermal coupling between the cookware item and the temperature sensor defined as a thermal coupling factor, and wherein the thermal coupling factor is determined according to a temperature change at the temperature sensor over the thermal coupling classification period.

15. The method of claim 13, wherein determining the thermal coupling behavior of the cookware item comprises:

determining an accumulated term based on a difference between a sensed temperature at the temperature sensor and the temperature setpoint over the thermal coupling classification period.

16. The method of claim 13, wherein adjusting the one or more parameters of the feedback controlled heating operation comprises:

adjusting a power level of the at least one heating element according to the determined thermal coupling behavior, the power level of the at least one heating element being adjusted from the default power level to an adjusted power level.

17. The method of claim 16, wherein the adjusted power level is one of a plurality of adjusted power levels, the plurality of adjusted power levels being stored within a lookup table.

18. The method of claim 16, wherein the adjusted power level is determined according to one or more equations based on the determined thermal coupling behavior and the temperature setpoint input.

19. The method of claim 16, wherein the feedback controlled heating operation further comprises:

directing the at least one heating element according to the adjusted power level for a remainder of the preheating phase.

20. The method of claim 13, wherein adjusting one or more parameters of the feedback controlled heating operation based on the thermal coupling behavior of the cookware item comprises:

adjusting a second portion of the preheating phase based on the determined thermal coupling behavior, the second portion of the preheating phase following the thermal coupling classification period.

* * * * *